US006627367B2

(12) United States Patent
Tomiuchi et al.

(10) Patent No.: US 6,627,367 B2
(45) Date of Patent: Sep. 30, 2003

(54) ELECTROPHOTOGRAPHIC PHOTOCONDUCTOR

(75) Inventors: Yoshimasa Tomiuchi, Nogano (JP); Hiroaki Yokouchi, Nogano (JP)

(73) Assignee: Fuji Electric Imaging Device Co., Ltd., Nogano (JP)

( * ) Notice: Subject to any disclaimer, the term of this patent is extended or adjusted under 35 U.S.C. 154(b) by 0 days.

(21) Appl. No.: 10/222,758

(22) Filed: Aug. 15, 2002

(65) Prior Publication Data

US 2003/0059694 A1 Mar. 27, 2003

Related U.S. Application Data

(63) Continuation-in-part of application No. 09/809,722, filed on Mar. 15, 2001, now abandoned.

(30) Foreign Application Priority Data

Mar. 15, 2000 (JP) ..... 2000-072584

(51) Int. Cl.[7] ..... G03G 5/04; G03G 5/05
(52) U.S. Cl. ..... 430/59.6; 430/56; 430/96
(58) Field of Search ..... 430/59.6, 56, 96

(56) References Cited

U.S. PATENT DOCUMENTS

| | | | | |
|---|---|---|---|---|
| 5,585,212 | A | 12/1996 | Ueda | 430/58 |
| 5,891,599 | A | 4/1999 | Fujimoto et al. | 430/59 |
| 6,017,665 | A | 1/2000 | Grune et al. | 430/58.2 |
| 6,197,463 | B1 | 3/2001 | Cais et al. | 430/58.05 |

FOREIGN PATENT DOCUMENTS

| | | | |
|---|---|---|---|
| DE | 10111719 | 9/2001 | G03G/5/04 |
| JP | 1206348 | 8/1989 | |

*Primary Examiner*—Christopher Rodee
(74) *Attorney, Agent, or Firm*—Darby & Darby

(57) ABSTRACT

An electrophotographic photoconductor a substrate and a photosensitive layer on the substrate. The photosensitive layer contains charge generation substance, charge transport substance and a binder resin. The binder resin has a dispersion $d_1$=Mz/Mw of at least 1.6, and/or a polydispersity $d_2$=Mw/Mn of at least 2.0, each of $d_1$ and $d_2$ being an indicator of a range of molecular weight distribution converted to polystyrene standard, wherein Mz, Mw and Mn are a z-average molecular weight, a weight-average molecular weight, and a number-average molecular weight of the binder resin, respectively. The resulting electrophotographic photoconductor minimizes film abrasion and filming, allowing the photoconductor to possess stable characteristics in repeated use over long periods.

7 Claims, 2 Drawing Sheets

ELECTROPHOTOGRAPHIC PHOTOCONDUCTOR

This application is a continuation-in-part of U.S. Ser. No. 09/809,722, filed Mar. 15, 2001, abandonded, which claims the benefit of Japanese Patent Application No. 2000-072584, filed Mar. 15, 2000, both of which are hereby incorporated by reference.

BACKGROUND OF THE INVENTION

The present invention relates to an electrophotographic photoconductor (hereinafter also called "a photoconductor"). More specifically, the present invention relates to a photoconductor having a photosensitive layer formed on a conductive substrate, the photosensitive layer including charge generation substance, charge transport substance, and a binder resin. Such a photoconductor is useful for printers and copiers employing electrophotographic system.

A photo conductor, having a general structure of a conductive substrate and a photosensitive layer laminated on the substrate, exhibits a photo conductive function. A photoconductor called "an organic photoconductor" contains organic compounds as functional components serving for charge generation and charge transport. Particularly, a laminated-layer type organic photoconductor, laminating functional layers including a charge generation layer and a charge transport layer, has advantages, such as flexibility in material selection, easy design of performances, high productivity by use of coating process, and superior safety. Therefore, application of such organic photoconductors to various types of copiers and printers has been actively researched in recent years.

In particular, a system that uses hole-transport substance of a distyryl compound having a triphenylamine skeleton and a binder resin of polycarbonate for a hole-transport layer is expected to provide a photoconductor with high responsibility due to high hole mobility of the system. However, there was a problem of abrasion caused by mechanical stresses by image-transfer with light-exposure and by a blade for toner removal.

In recent years, organic photoconductors have remarkably developed in sensitivity and durability against repeated printings by virtue of inventions of charge generation materials and charge transport materials exhibiting excellent characteristics, as well as inventions of resins exhibiting high mechanical strength and favorable compatibility. Nevertheless, the known organic photoconductors are inferior in durability against repeated printings to photoconductors using inorganic materials of selenium and tellurium, as well as to photoconductors using amorphous silicon.

In order to solve the above problem, attempts to improve durability against repeated printings have been made by using polycarbonate with a large viscosity-average molecular weight. For example, the use of bisphenol A polycarbonate resin is disclosed in Japanese Unexamined Patent Application Publication (KOKAI) No. S62-160458, and the use of bisphenol Z polycarbonate resin is disclosed in Japanese Unexamined Patent Application Publication (KOKAI) No. H5-165230. However, technology has not yet been established that satisfies requirements for suppressing film-abrasion and for preventing "filming", which is caused by the toner attached on the photoconductor surface.

OBJECTS AND SUMMARY OF THE INVENTION

It is an object of the present invention to provide an electrophotographic photoconductor which solves the foregoing problems.

It is a further object of the present invention to provide an electrophotographic photo conductor that exhibits minimal film-abrasion, as well as minimal probability of filming, and thus, high stability under repeated use for a long period of time, while retaining favorable characteristics of an organic photoconductor.

To solve the above problem, an electrophotographic photoconductor according to one aspect of the present invention comprises a conductive substrate and a photosensitive layer on the substrate. The photosensitive layer contains a charge generation substance, a charge transport substance and a binder resin, wherein the binder resin has a dispersion $d_1$, which indicates a range of molecular weight distribution of the resin and is defined by a ratio of the z-average molecular weight Mz to the weight-average molecular weight Mw, i.e., $d_1$=Mz/Mw, of 1.6 or larger in a value converted to polystyrene standard. Moreover, the binder resin has a polydispersity $d_2$, which also indicates a range of molecular weight distribution of the resin and is defined by a ratio of a weight-average molecular weight Mw to a number-average molecular weight Mn, i.e., $d_2$=Mw/Mn, of 2.0 or larger in a value converted to polystyrene standard.

An electrophotographic photoconductor according to another aspect of the present invention comprises a conductive substrate and a photosensitive layer including a charge generation layer and a charge transport layer on the substrate. The photosensitive layer contains a charge generation substance. The charge transport layer contains a charge transport substance and a binder resin, wherein the binder resin has a dispersion $d_1$, which indicates a range of molecular weight distribution of the resin and is defined by a ratio of the z-average molecular weight Mz to the weight-average molecular weight Mw, i.e., $d_1$=Mz/Mw, of 1.6 or larger in a value converted to polystyrene standard. Moreover, the binder resin has a polydispersity $d_2$, which also indicates a range of molecular weight distribution of the resin and is defined by a ratio of a weight-average molecular weight Mw to a number-average molecular weight Mn, i.e., $d_2$=Mw/Mn, of 2.0 or larger in a value converted to polystyrene standard.

In the above two embodiments, the binder resin preferably is prepared so that the dispersion $d_1$ ranges from 1.6 to 3.2 and the polydispersity $d_2$ ranges from 2.0 to 3.7. More preferably, the dispersion $d_1$ ranges from 1.6 to 2.6 and the polydispersity $d_2$ ranges from 2.0 to 3.2. According to another embodiment, the binder resin has a dispersion $d_1$ of from 1.6 to 3.250 and a polydispersity $d_2$ of from 2.0 to 3.800. According to yet another embodiment, the binder resin has a dispersion $d_1$ of from 1.6, 1.7, 1.8, 1.9, or 2.0 to 2.4, 2.5, 2.6, 2.7, 2.8, 2.9, 3.0, 3.1, or 3.2 and a polydispersity $d_2$ of from 2.0, 2.1, 2.2, 2.3, 2.4, 2.5, 2.6, to 2.8, 2.9, 3.0, 3.1, 3.2, 3.3, 3.4, 3.5, 3.6, or 3.7.

According to one embodiment, the charge transport layer and/or photosensitive layer contains only one type of binder resin.

Advantageously, a polycarbonate resin may be used as the binder resin.

According to another embodiment, the photosensitive layer is free of organosilanes.

According to yet another embodiment, one or both of the charge transport layer and the charge generation layer are free of organosilanes.

To solve the problem described earlier, the inventors of the present invention have made numerous studies and reached an idea, while not holding to any one particular theory, that giving the polymer of the binder resin a wide range of molecular weight and large overlapping formed by entanglement of principal chains of the polymer should be effective for improving abrasion resistance and also preventing filming of a photoconductor.

A synthetic polymer material is a collection of various species of molecules having different molecular weights. Mean values of the molecular weight differ each other depending on their calculation methods. There are three mean values of molecular weight: (1) a z-average molecular weight Mz averaged over z-values of each species of molecule, (2) a weight-average molecular weight Mw averaged over total weights of each species of molecule, and (3) a number-average molecular weight Mn simply averaged over molecular weights of each species of molecule. Precise definitions of these averages will be given later by equations (1), (2) and (3).

A collection of molecules consisting of molecules with wide range of molecular weight distribution has large difference between two averages of the three averages mentioned above. Namely, this kind of collection of molecules shows large difference between a z-average molecular weight and a weight-average molecular weight or large difference between a weight-average molecular weight and a number-average molecular weight. $d_1$=Mz/Mw, a ratio of a z-average molecular weight to a weight-average molecular weight, is called dispersion and is an indicator of a range of molecular weight distribution. While, $d_2$=Mw/Mn, a ratio of weight-average molecular weight to number-average molecular weight, is called polydispersity and is another indicator of a range of molecular weight distribution. Thus, the range of molecular weight distribution may be considered in terms of the dispersion $d_1$ or the polydispersity $d_2$.

The average values, a z-average molecular weight Mz, a weight-average molecular weight Mw, and a number-average molecular weight Mn, are defined by the following equations (1), (2) and (3), and actually obtained from a chromatogram of SEC (size exclusion chromatography) using the equations.

$$Mz = \frac{\sum (M_i^3 N_i)}{\sum (M_i^2 N_i)} = \frac{\sum (H_i M_i^2)}{\sum (H_i M_i)} \quad (1)$$

$$Mw = \frac{\sum (w_i M_i)}{w} = \frac{\sum (M_i^2 N_i)}{\sum (M_i N_i)} = \frac{\sum (H_i M_i)}{\sum H_i} \quad (2)$$

$$Mn = \frac{w}{\sum N_i} = \frac{\sum (M_i N_i)}{\sum N_i} = \frac{\sum H_i}{\sum (H_i / M_i)} \quad (3)$$

where "w" represents weight of the sample, "M", a molecular weight, "N", a number of molecules, "H", height of chromatogram, and "i" represents i-th species of the polymer molecule and corresponds to i-th retention volume in the chromatography.

The inventors of the present invention have made studies on printing durability including abrasion and filming as well as coating characteristic, and have found that excellent printing durability and sensitivity characteristic are obtained by a photoconductor, in which the binder resin of the photosensitive layer of the photoconductor has dispersion $d_1$=Mz/Mw of at least 1.6 or polydispersity $d_2$=Mw/Mn of at least 2.0, where $d_1$ and $d_2$ are values converted to polystyrene standard. Mz is a z-average molecular weight, Mw, a weight-average molecular weight, and Mn, a number-average molecular weight. The present invention has been accomplished based on the finding. The inventors also found in the studies that this favorable effect is significant when polycarbonate is used as a binder resin.

In addition to the above effect, the wide range of molecular weight of the resin used in a photoconductor brings about an advantage in coating characteristic. If only a resin having a large value of a number-average molecular weight is used alone, such problems in coating process arise that viscosity is too large to facilitate coating operation and that the use of large amount of solvent causes excessive cooling of the photoconductor by large heat of vaporization in its drying process down to the temperature under a dew point resulting in dew condensation. Thus, high durability and ease of coating are in a trade-off relationship in conventional photoconductors This problem is solved by a resin having a range of molecular weight distribution larger than certain value according to the present invention.

The photoconductor of the present invention, even in repeated use for a long period of time, holds excellent electrophotographic characteristics, in particular, image reliability and stability in repeated use. The photoconductor of the present invention also may be applied to electrophotographic systems including a laser printer and an electrophotographic platemaking apparatus as well as a copier.

It has been confirmed that an actual electrophotographic system equipped with a photoconductor of the present invention does not cause deterioration of such characteristics as electric potential and sensitivity, even after a long period of time in service. Optical fatigue due to image exposure, mechanical stress due to rollers for charging and transfer and due to blades contacting with the photoconductor for toner removal, and thermal fatigue would cause abrasion and filming of the photoconductor. However, the abrasion and filming are effectively suppressed in a photoconductor of the present invention.

The above, and other objects, features and advantages of the present invention will become apparent from the following description read in conjunction with the accompanying drawings, in which like reference numerals designate the same elements.

DETAILED DESCRIPTION OF THE INVENTION

Now, the invention will be described in greater detail with reference to certain aspects of preferred embodiments thereof and the accompanying drawings.

Figure 1:
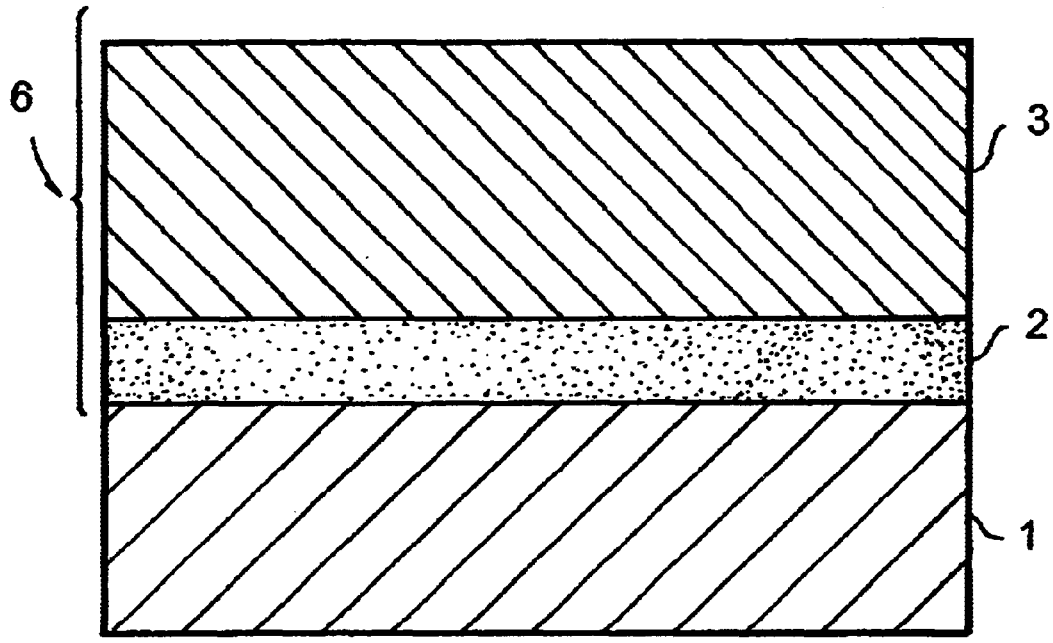
FIG. 1 is a schematic cross sectional view showing a negative-charging laminated-layer type photoconductor as one example of the present invention.

Referring to FIG. 1, the so-called negative-charging laminated-layer type photoconductor has a substrate 1 and a photosensitive layer 6 including a charge generation layer 2 and a charge transport layer 3.

Figure 2:
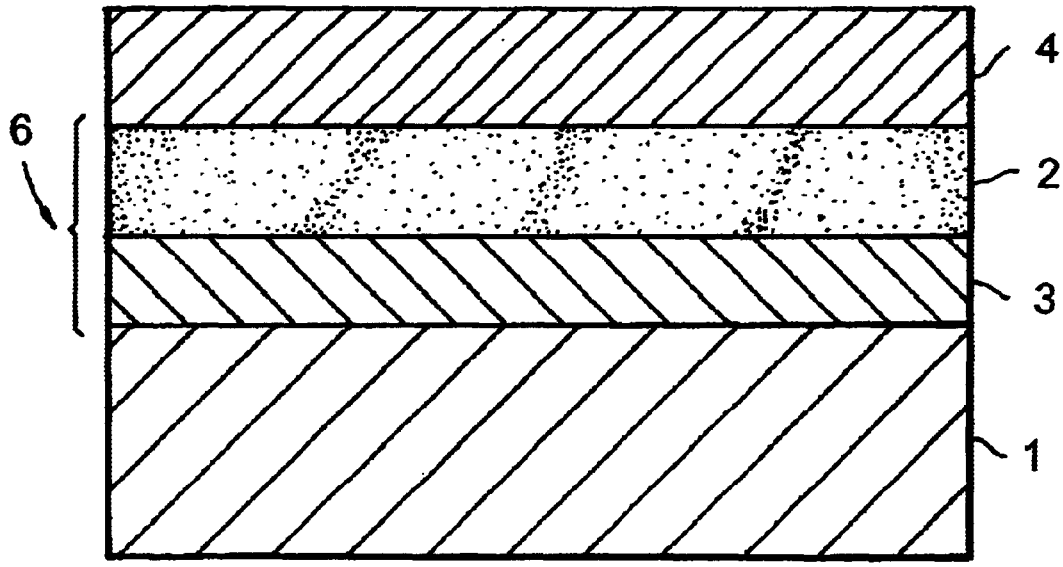
FIG. 2 is a schematic cross sectional view showing a positive-charging laminated-layer type photoconductor as another example of the present invention.

Referring to FIG. 2, the so-called positive-charging laminated-layer type photoconductor has a substrate 1, a photosensitive layer 6 including a charge generation layer 2 and a charge transport layer 3, and a protective layer 4.

Figure 3:
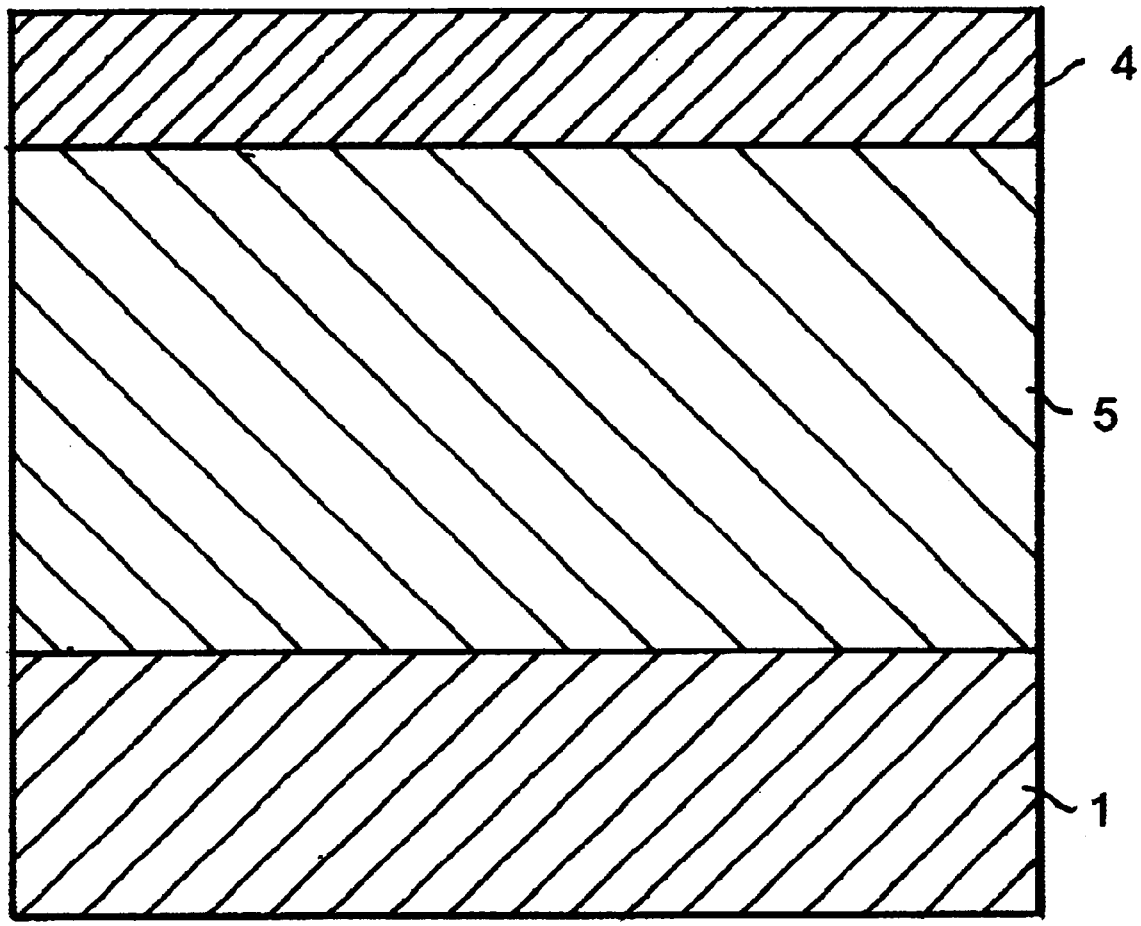
FIG. 3 is a schematic cross sectional view showing a positive-charging single-layer type photoconductor as still another example of the present invention.

Referring to FIG. 3, the so-called positive-charging single layer type photoconductor has a substrate 1, a single photosensitive layer 5, and a protective layer 4. The protective layer is optionally provided. An intermediate layer, not shown in the figures, may be provided between the substrate and the photosensitive layer. While not being limited in scope, the invention will be described in detail with reference to a negative-charging laminated-layer type photoconductor.

Substrate 1 may be formed by an electrically conductive substrate alone, such as an aluminum cylindrical tube or an aluminum-deposited film, or such a substrate may have its surface treated to form anodized aluminum or to decorate with resin film.

Material of a polymer dispersion film used for the surface decoration of the conductive substrate may be selected from an insulative polymer, such as casein, poly(vinyl alcohol), nylon, polyamide, melamine or cellulose, a conductive polymer, such as polythiophene, polypyrrole or polyaniline, and these polymers to which metal oxide powder or low molecular weight compound is added.

Charge generation layer 2 includes charge generation substance and a binder resin. The charge generation substance may be selected from phthalocyanine compounds, azo compounds and derivatives of these compounds. Specific examples of the charge generation substances are shown by the chemical formulas (I-1) to (I-18).

(I-1)

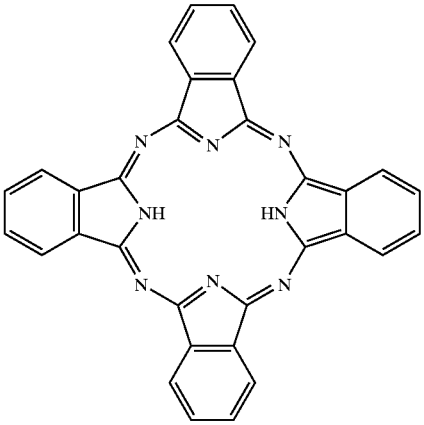

(I-2)

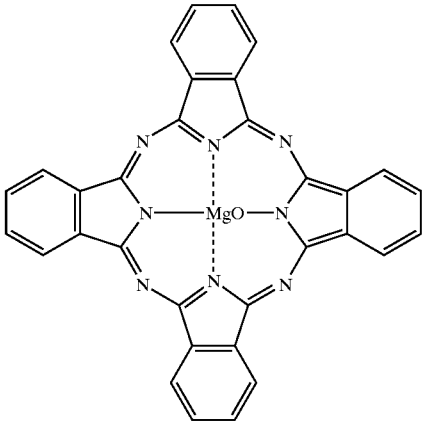

(I-3)

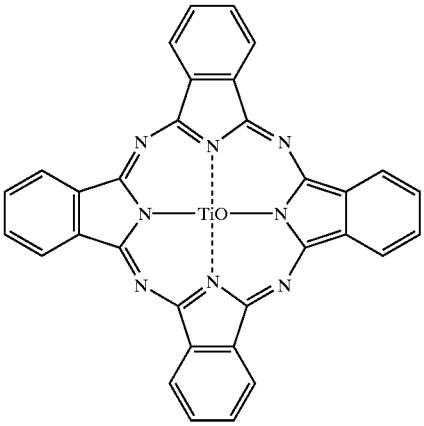

(I-4)

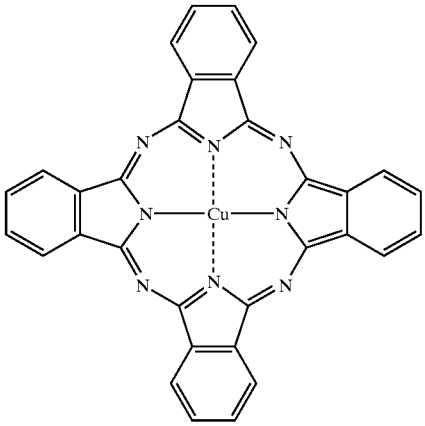

(I-5)

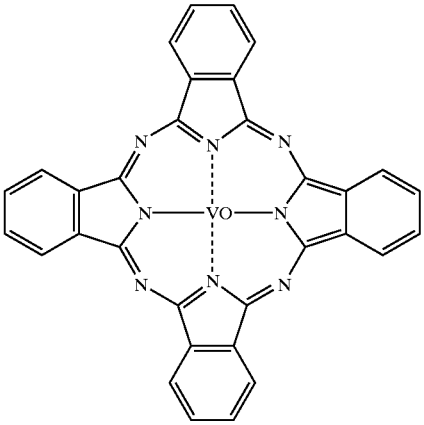

(I-6)

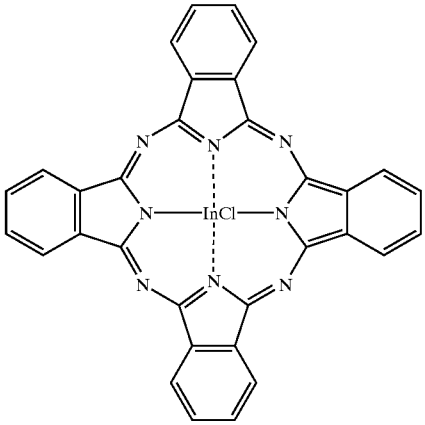

-continued
(I-7)
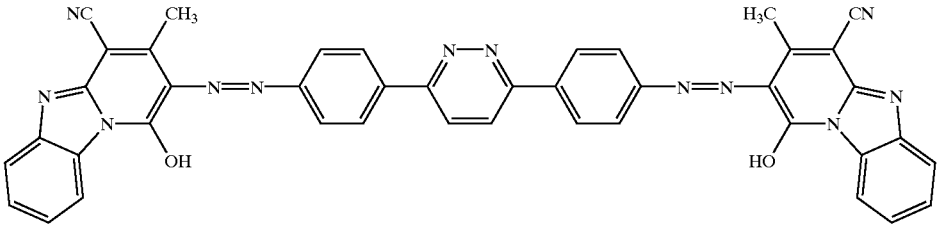
(I-8)
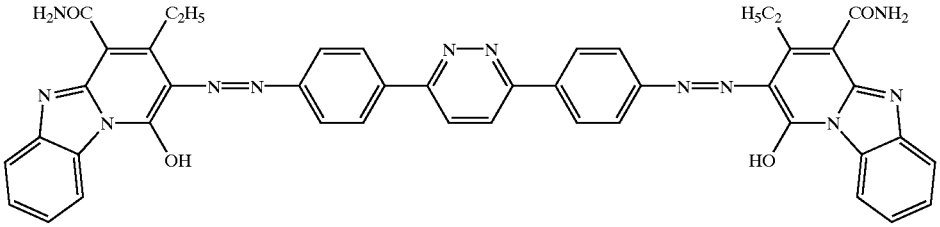
(I-9)
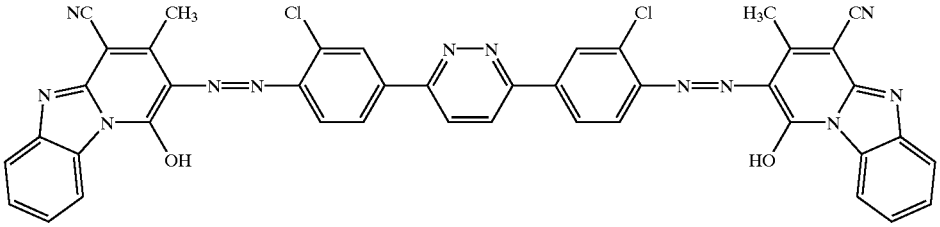
(I-10)
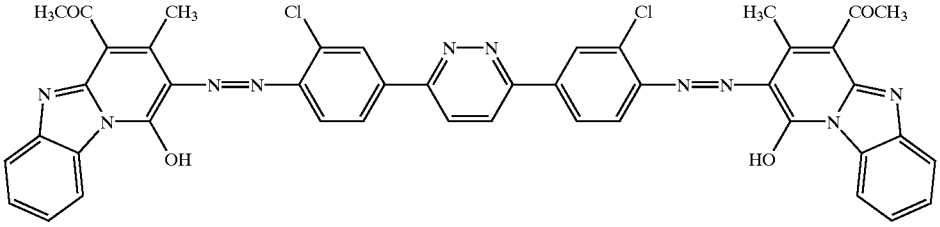
(I-11)
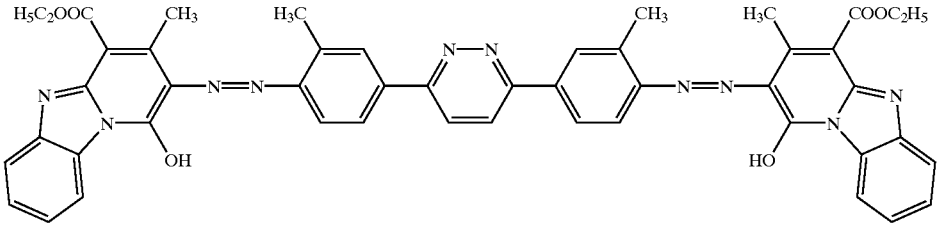
(I-12)
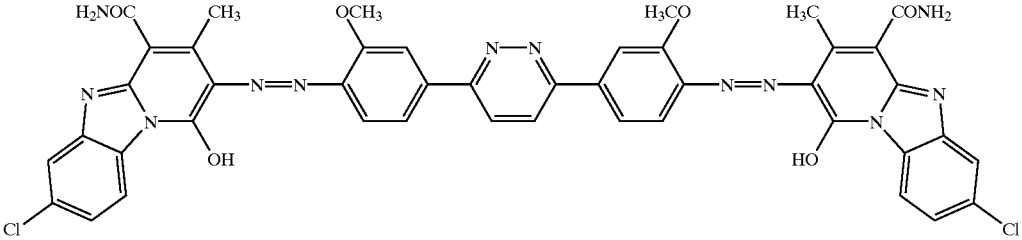

-continued (I-13)

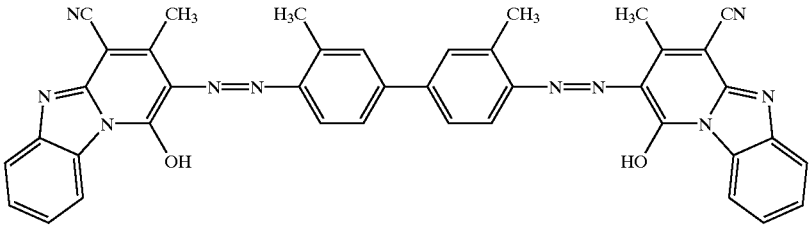

(I-14)

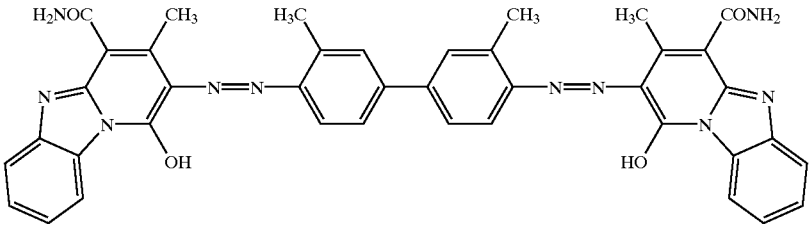

(I-15)

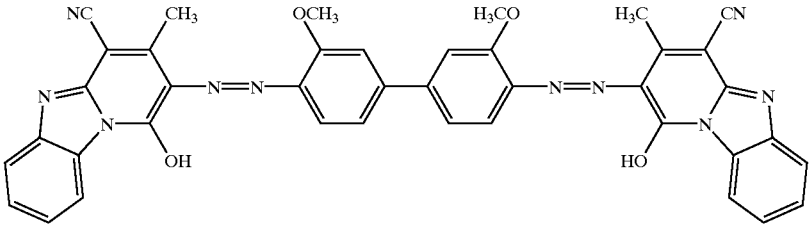

(I-16)

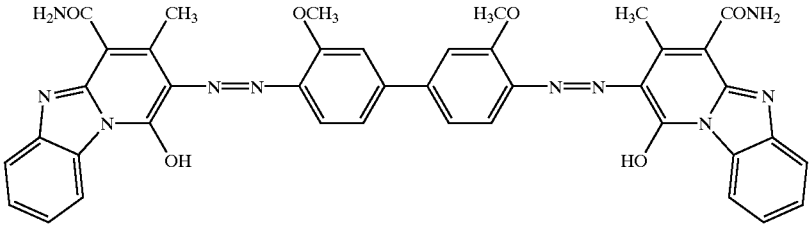

(I-17)

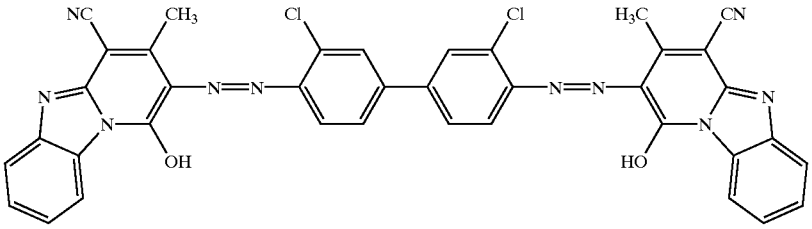

(I-18)

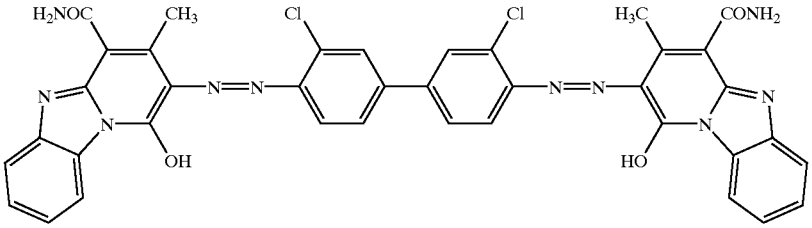

The binder resin used in the charge generation layer may be selected from polycarbonate, polyester, polyamide, polyurethane, epoxy resin, poly(vinyl butyral), poly(vinyl acetal), phenoxy resin, silicone resin, acrylic resin, vinyl chloride resin, vinylidene chloride resin, vinyl acetate resin, polyvinyl formal, cellulose resin, copolymers of these substances, halide and cyanoethylate of these substances, and a mixture of these substances.

Charge transport layer 3 includes charge transport substance and a binder resin. The charge transport substance may be selected from hydrazone compounds, amine compounds, and appropriate combinations of these substances. Specific examples of the charge transport substances are shown by the chemical formulas (II-1) to (II-12).

(II-1)
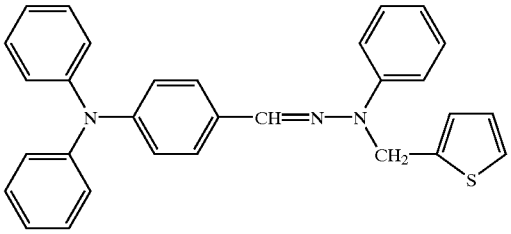
(II-2)
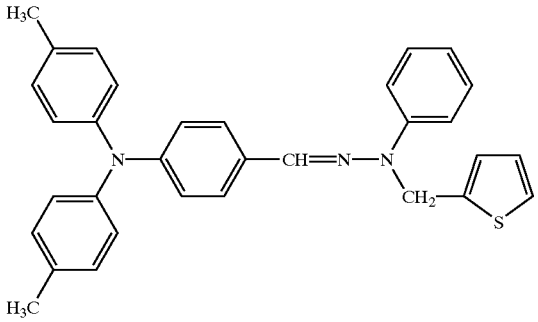
(II-3)
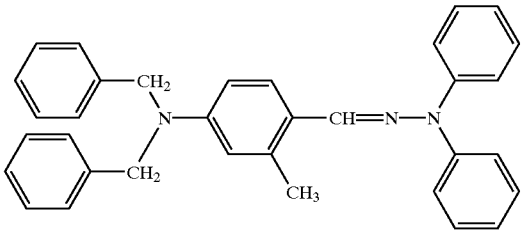
(II-4)
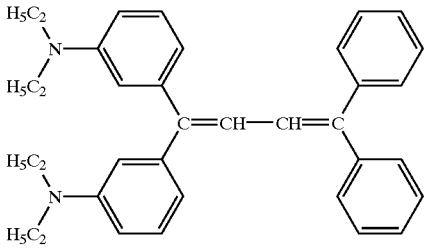
(II-5)
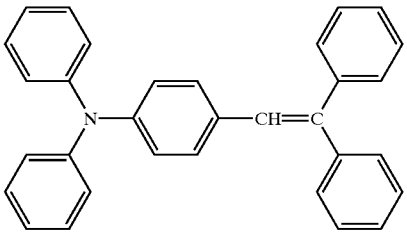
(II-6)
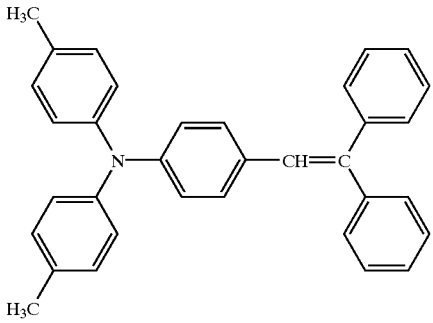
(II-7)
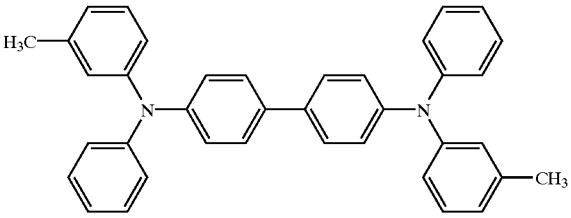
(II-8)
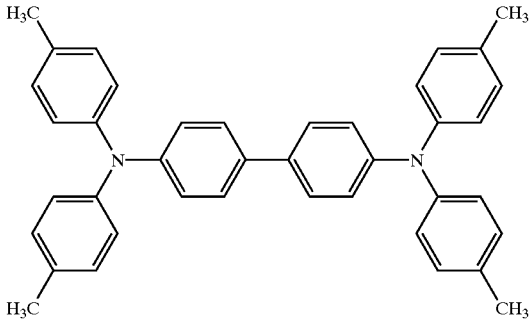
(II-9)
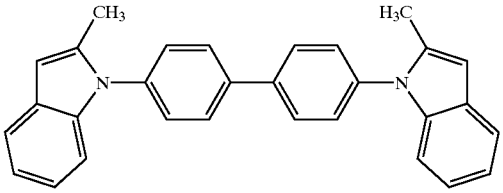
(II-10)
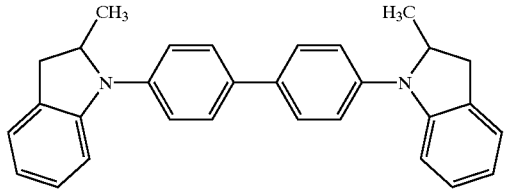

-continued (II-11)

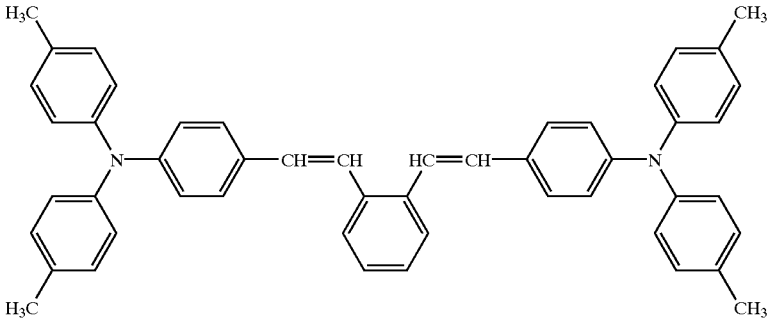

(II-12)

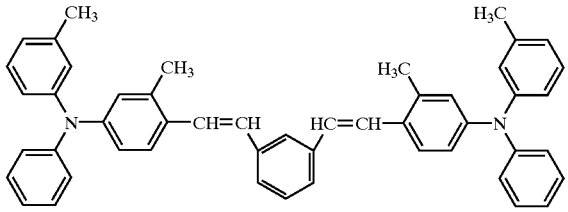

The binder resin used in the charge transport layer may be selected from polycarbonate, polystyrene, allyl resin, polyphenylene ether, and acrylic resin. Specific examples of the binder resin are shown by the chemical formulas (III-1) to (III-8). Polycarbonate is preferably used for the binder resin of the charge transport layer, although not limited to polycarbonate.

(III-1)

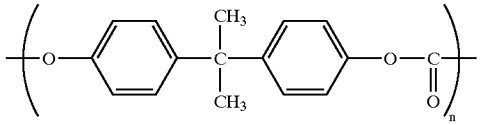

(III-2)

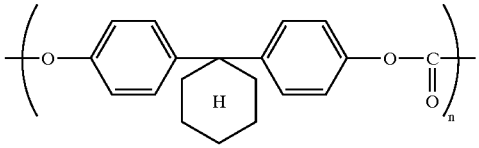

(III-3)

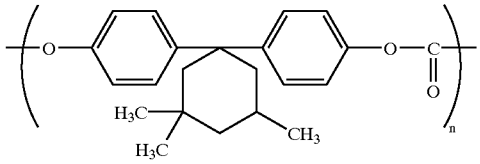

(III-4)

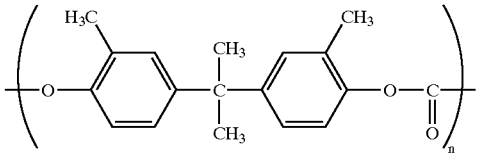

(III-5)

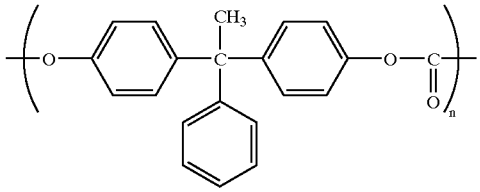

(III-6)

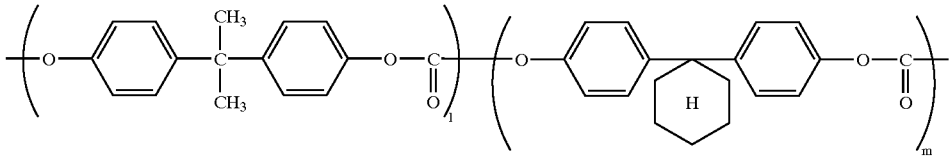

(III-7)

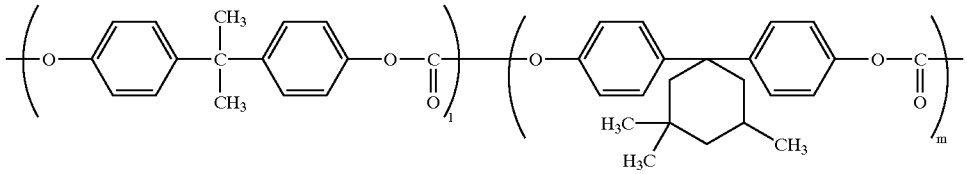

-continued (III-8)

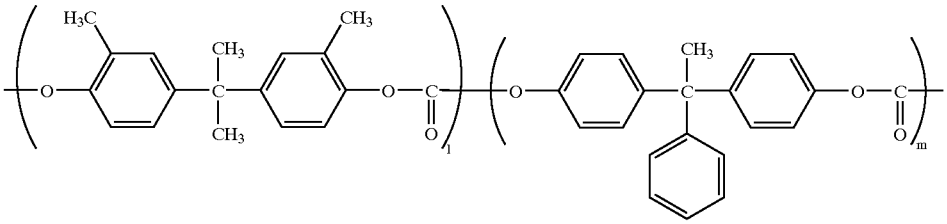

The binder resin for the charge transport layer of the photoconductor according to the present invention is prepared so that the dispersion $d_1$, an indicator of a range of molecular weight distribution, is at least 1.6, and the polydispersity $d_2$ is at least 2.0, where both $d_1$ and $d_2$ are values converted to polystyrene standard. A preferred result is obtained by a photoconductor in which the binder resin of the charge transport layer is prepared so that the dispersion $d_1$ is in the range from 1.6 to 3.2 and the polydispersity $d_2$ is in the range from 2.0 to 3.7. More preferably, the binder resin has a dispersion $d_1$ of from 1.6 to 2.6 and a polydispersity $d_2$ of from 2.0 to 3.2.

The polycarbonate resins exemplified above may be synthesized by a known method, such as melt polycondensation through transesterification reaction or interface condensation of dicarboxylic acid chloride and alkali salt, to obtain a polycarbonate resin having desired dispersion or polydispersity of the molecular weight distribution.

The photoconductor may contain an antioxidant agent as an additive. The specific examples of the antioxidant agent are shown by the chemical formulas (IV-1) to (IV-45).

In the case the photoconductor is of a single-layer type, photosensitive layer 5 contains charge generation substance, charge transport substance and a binder resin, in which the binder resin is prepared so that the dispersion $d_1$ or polydispersity $d_2$, indicators of a range of molecular weight distribution, is in the range given above for the case of the laminated-layer type photoconductor. The material of the binder resin may also be selected from similar substances to those in the laminated-layer type photoconductor.

(IV-1)

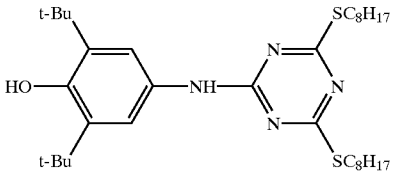

(IV-2)

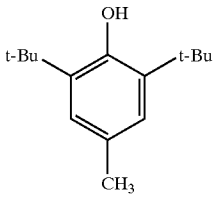

(IV-3)

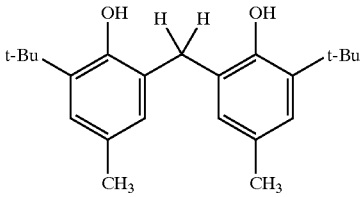

-continued (IV-4)

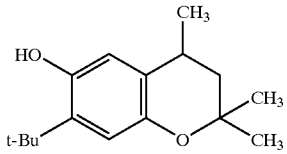

(IV-5)

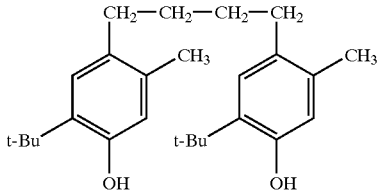

(IV-6)

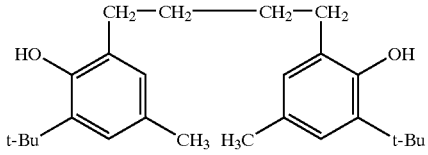

(IV-7)

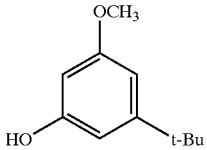

(IV-8)

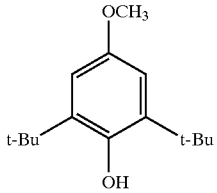

(IV-9)

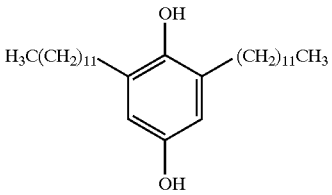

(IV-10)

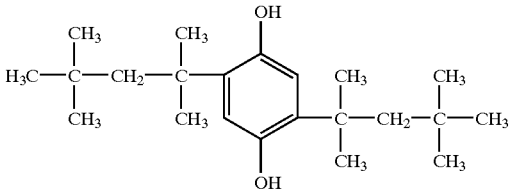

-continued
(IV-11)
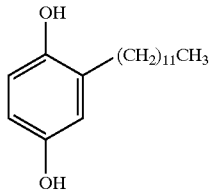
(IV-12)
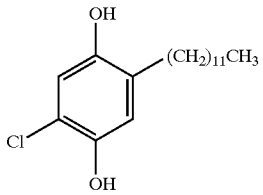
(IV-13)
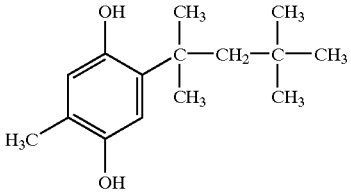
(IV-14)
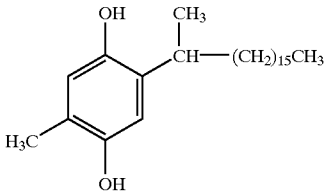
(IV-15)
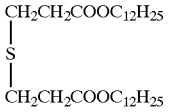
(IV-16)
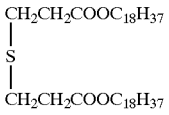
(IV-17)
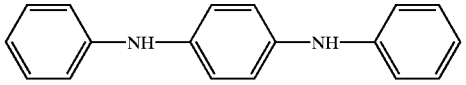
(IV-18)
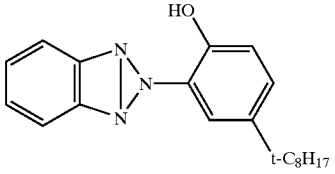
(IV-19)
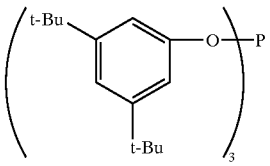
-continued
(IV-20)
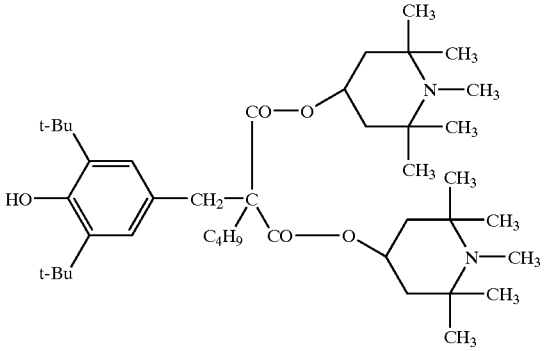
(IV-21)
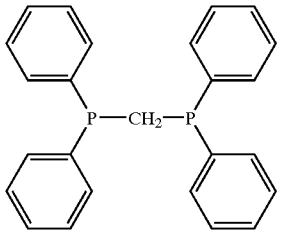
(IV-22)
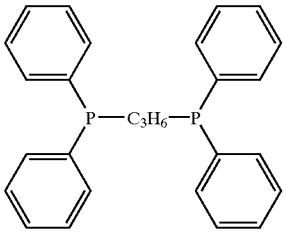
(IV-23)
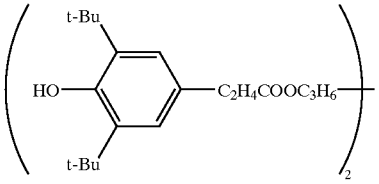
(IV-24)
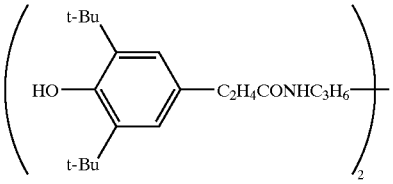
(IV-25)
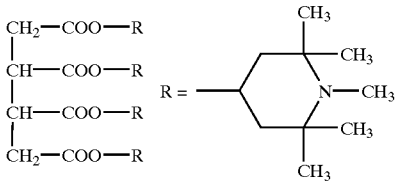
(IV-26)
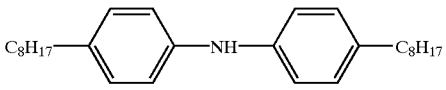

-continued
(IV-27)
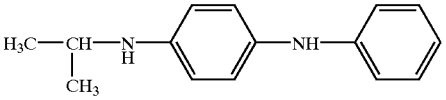
(IV-28)
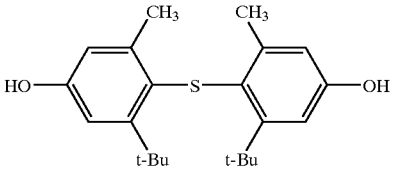
(IV-29)
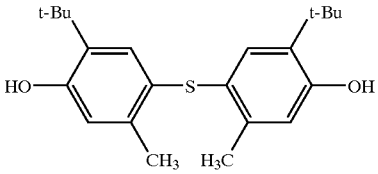
(IV-30)
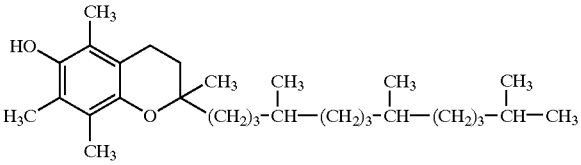
(IV-31)
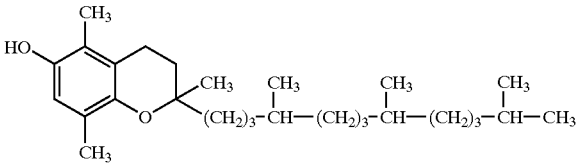
(IV-32)
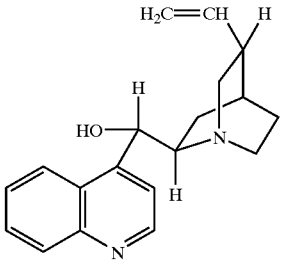
(IV-33)
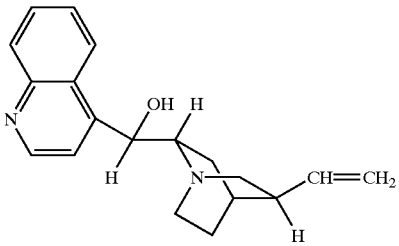
(IV-34)
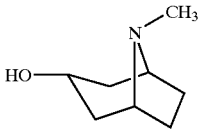
-continued
(IV-35)
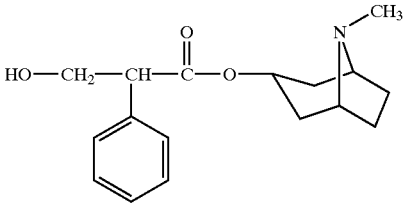
(IV-36)
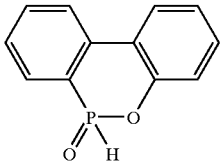
(IV-37)
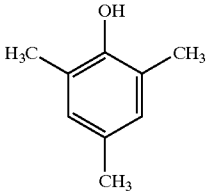
(IV-38)
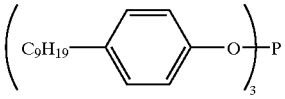
(IV-39)
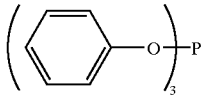
(IV-40)
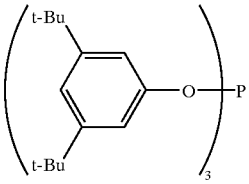
(IV-41)
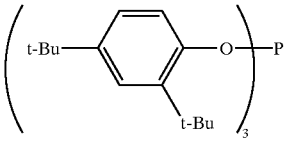
(IV-42)
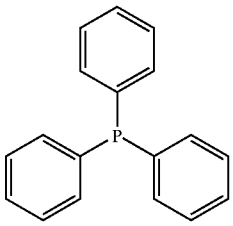
(IV-43)
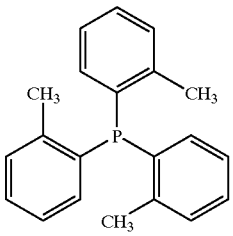

-continued (IV-44)

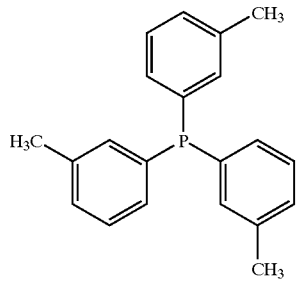

(IV-45)

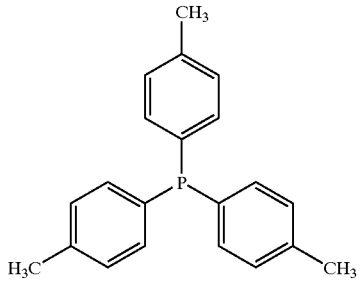

EXAMPLES

Although the present invention will be described in further detail in the following referring to specific examples of the embodiment thereof, the invention shall not be limited by the examples. The conductive substrate of every Example or Comparative Example in the following is an aluminum cylindrical tube having thickness of 1 mm, length of 310 mm and outer diameter of 60 mm. The cylindrical tube was used for a conductive substrate after cleaning and drying.

Example 1 (E1)

An intermediate layer was formed by dip-coating the surface of the above-described substrate with a coating liquid and dried at 90° C. for 30 min, to be a resin layer having thickness of 0.1 μm. The coating liquid for the resin film of the intermediate layer was prepared by dissolving 10 parts by weight of an alcohol-soluble copolymerized polyamide resin CM 8000 (manufactured by Toray Industries Co., Ltd.) into mixed solvent of 45 parts by weight of methanol and 45 parts by weight of methylene chloride.

Then, a charge generation layer having film thickness of 0.2 μm was formed by dip-coating the intermediate layer with a coating liquid followed by drying at 90° C. for 30 min. The coating liquid for the charge generation layer was prepared by mixing 1 part by weight of poly(vinyl acetal) resin S-LEC KS-1 (manufactured by Sekisui Chemical Co., Ltd.) and 1 part by weight of the bisazo compound of formula (I-17) as charge generation substance with 150 parts by weight of methylethyl ketone, and subjecting to dispersion treatment in a ballmill for 48 hrs.

Subsequently, a charge transport layer having thickness of 20 μm was formed by dip-coating the charge generation layer with a coating liquid followed by drying at 90° C. for 30 min. The coating liquid for the charge transport layer was prepared by dissolving a mixed material of 100 parts by weight of the diamine compound of the formula (II-7) as charge transport substance and 100 parts by weight of the bisphenol Z polycarbonate of the formula (III-2) as a resin binder, and 5 parts by weight of a hindered phenol compound of the formula (IV-9), in 700 parts by weight of dichloromethane. Here, this bisphenol Z polycarbonate had the values of average molecular weight and ratios between them of Mw=58,847, Mz=97,215, Mn=28,224, Mz/Mw=1.652, and Mw/Mn=2.085.

Example 2 (E2)

A photoconductor was fabricated in the same manner as in Example 1 except that the resin binder of the charge transport layer was replaced by 100 parts by weight of bisphenol Z polycarbonate of the formula (III-2) that had the values: Mw=90,703, Mz=166,894, Mn=42,031, Mz/Mw=1.840, and Mw/Mn=2.157.

Example 3 (E3)

A photoconductor was fabricated in the same manner as in Example 1 except that the resin binder of the charge transport layer was replaced by 100 parts by weight of bisphenol Z polycarbonate of the formula (III-2) that had the values: Mw=125,775, Mz=408,768, Mn=53,361, Mz/Mw=3.250, and Mw/Mn=2.375.

Example 4 (E4)

A photoconductor was fabricated in the same manner as in Example 1 except that the resin binder of the charge transport layer was replaced by 100 parts by weight of bisphenol A polycarbonate of the formula (III-1) that had the values: Mw=55,659, Mz=90,724, Mn=24,354, Mz/Mw=1.630, and Mw/Mn=2.285.

Example 5 (E5)

A photoconductor was fabricated in the same manner as in Example 1 except that the resin binder of the charge transport layer was replaced by 100 parts by weight of bisphenol A polycarbonate of the formula (III-1) that had the values: Mw=118,527, Mz=256,374, Mn=47,354, Mz/Mw=2.163, and Mw/Mn=2.503.

Example 6 (E6)

A photoconductor was fabricated in the same manner as in Example 1 except that the resin binder of the charge transport layer was replaced by 100 parts by weight of isophorone type polycarbonate of the formula (III-3) that had the values: Mw=64,030, Mz=114,166, Mn=31,950, Mz/Mw=1.783, and Mw/Mn=2.004.

Example 7 (E7)

A photoconductor was fabricated in the same manner as in Example 1 except that the resin binder of the charge transport layer was replaced by 100 parts by weight of bisphenol C polycarbonate of the formula (III-4) that had the values: Mw=88,945, Mz=167,306, Mn=33,794, Mz/Mw=1.881, and Mw/Mn=2.632.

Example 8 (E8)

A photoconductor was fabricated in the same manner as in Example 1 except that the resin binder of the charge transport layer was replaced by 100 parts by weight of polycarbonate of the formula (III-5) that had the values: Mw=118,908, Mz=193,107, Mn=37,987, Mz/Mw=1.624, and Mw/Mn=3.130.

Example 9 (E9)

A photoconductor was fabricated in the same manner as in Example 1 except that the resin binder of the charge transport layer was replaced by 100 parts by weight of copolymerized polycarbonate of the formula (III-6) that had the values: Mw=107,046, Mz=276,285, Mn=35,072, Mz/Mw=2.581, and Mw/Mn=3.052.

Example 10 (E10)

A photoconductor was fabricated in the same manner as in Example 1 except that the resin binder of the charge transport layer was replaced by 100 parts by weight of copolymerized polycarbonate of the formula (III-7) that had the values: Mw=68,212, Mz=121,758, Mn=31,404, Mz/Mw=1.785, and Mw/Mn=2.017.

Example 11 (E11)

A photoconductor was fabricated in the same manner as in Example 1 except that the resin binder of the charge transport layer was replaced by 100 parts by weight of copolymerized polycarbonate of the formula (III-8) that had the values: Mw=156,578, Mz=367,958, Mn=41,423, Mz/Mw=2.350, and Mw/Mn=3.800.

Example 12 (E12)

A photoconductor was fabricated in the same manner as in Example 1 except that the charge generation substance was replaced by a metal phthalocyanine compound of the formula (I-3).

Example 13 (E13)

A photoconductor was fabricated in the same manner as in Example 1 except that the charge generation substance was replaced by a bisazo compound of the formula (I-7).

Example 14 (E14)

A photoconductor was fabricated in the same manner as in Example 1 except that the charge transport substance was replaced by a butadiene compound of the formula (II-4).

Example 15 (E15)

A photoconductor was fabricated in the same manner as in Example 1 except that the charge transport substance was replaced by a styryl compound of the formula (II-11).

Example 16 (E16)

A photoconductor was fabricated in the same manner as in Example 1 except that the antioxidant in the charge transport layer was replaced by a compound of the formula (IV-30).

Example 17 (E17)

A photoconductor was fabricated in the same manner as in Example 1 except that the antioxidant in the charge transport layer was replaced by a compound of the formula (IV-37).

Comparative Example 1 (CE1)

A photoconductor was fabricated in the same manner as in Example 1 except that the resin binder of the charge transport layer was replaced by 100 parts by weight of bisphenol Z polycarbonate of the formula (III-2) that had the values: Mw=40,686, Mz=62,290, Mn=22,548, Mz/Mw=1.531, and Mw/Mn=1.804.

Comparative Example 2 (CE2)

A photoconductor was fabricated in the same manner as in Example 1 except that the resin binder of the charge transport layer was replaced by 100 parts by weight of bisphenol Z polycarbonate of the formula (III-2) that had the values: Mw=60,845, Mz=93,580, Mn=38,028, Mz/Mw=1.538, and Mw/Mn=1.600.

Comparative Example 3 (CE3)

A photoconductor was fabricated in the same manner as in Example 1 except that the resin binder of the charge transport layer was replaced by 100 parts by weight of bisphenol Z polycarbonate of the formula (III-2) that had the values: Mw=93,562, Mz=135,010, Mn=53,259, Mz/Mw=1.443, and Mw/Mn=1.757.

Comparative Example 4 (CE4)

A photoconductor was fabricated in the same manner as in Example 1 except that the resin binder of the charge transport layer was replaced by 100 parts by weight of bisphenol A polycarbonate of the formula (III-1) that had the values: Mw=52,831, Mz=80,673, Mn=32,542, Mz/Mw=1.527, and Mw/Mn=1.623.

Comparative Example 5 (CE5)

A photoconductor was fabricated in the same manner as in Example 1 except that the resin binder of the charge transport layer was replaced by 100 parts by weight of bisphenol A polycarbonate of the formula (III-1) that had the values: Mw=86,158, Mz=132,597, Mn=47,223, Mz/Mw=1.539, and Mw/Mn=1.825.

Comparative Example 6 (CE6)

A photoconductor was fabricated in the same manner as in Example 1 except that the resin binder of the charge transport layer was replaced by 100 parts by weight of isophorone type polycarbonate of the formula (III-3) that had the values: Mw=55,705, Mz=82,332, Mn=31,232, Mz/w=1.478, and Mw/Mn=1.783.

Comparative Example 7 (CE7)

A photoconductor was fabricated in the same manner as in Example 1 except that the resin binder of the charge transport layer was replaced by 100 parts by weight of bisphenol C polycarbonate of the formula (III-4) that had the values: Mw=54,789, Mz=83,772, Mn=33,129, Mz/Mw=1.529, and Mw/Mn=1.654.

Comparative Example 8 (CE8)

A photoconductor was fabricated in the same manner as in Example 1 except that the resin binder of the charge transport layer was replaced by 100 parts by weight of polycarbonate of the formula (III-5) that had the values: Mw=60,612, Mz=89,039, Mn=34,524, Mz/Mw=1.469, and Mw/Mn=1.756.

Comparative Example 9 (CE9)

A photoconductor was fabricated in the same manner as in Example 1 except that the resin binder of the charge transport layer was replaced by 100 parts by weight of copolymerized polycarbonate of the formula (III-6) that had the values: Mw=80,106, Mz=126,728, Mn=45,283, Mz/Mw=1.582, and Mw/Mn=1.769.

Comparative Example 10 (CE10)

A photoconductor was fabricated in the same manner as in Example 1 except that the resin binder of the charge transport layer was replaced by 100 parts by weight of copolymerized polycarbonate of the formula (III-7) that had the values: Mw=78,943, Mz=119,362, Mn=42,580, Mz/Mw=1.512, and Mw/Mn=1.854.

Comparative Example 11 (CE11)

A photoconductor was fabricated in the same manner as in Example 1 except that the resin binder of the charge transport layer was replaced by 100 parts by weight of copolymerized polycarbonate of the formula (III-8) that had the values: Mw=85,191, Mz=132,983, Mn=45,242, Mz/Mw=1.561, and Mw/Mn=1.883.

Evaluation of the Photoconductors

Evaluation of each of the Examples and Comparative Examples was conducted in terms of dispersion and polydispersity of the polycarbonate in the charge transport layer and characteristics of the photoconductor including an amount of abrasion, occurrence of filming, and dew condensation on the photoconductor surface.

The dispersion and polydispersity were measured by means of gel permeation chromatography (GPC). In the method, 100 $\mu$l of a solution prepared by dissolving 0.02 g of a specimen taken from the charge transport layer in 5 ml of tetrahydrofuran was injected into the column with flow velocity of 1 ml/min. The column temperature was set at 40° C. The GPC and the column used in the measurement were products of Waters Corporation, MA, USA, and the polystyrene standard sample was "TSK standard" manufactured by TOSOH Corporation, Tokyo, Japan. The results of the evaluation are shown in Tabled 1 through 5.

TABLE 1

| specimen | E1 | E2 | E3 | E4 | E5 | E6 |
|---|---|---|---|---|---|---|
| CTL binder resin (*1) | III-2 | III-2 | III-2 | III-1 | III-1 | III-3 |
| CG substance (*2) | I-17 | I-17 | I-17 | I-17 | I-17 | I-17 |
| CT substance (*3) | II-7 | II-7 | II-7 | II-7 | II-7 | II-7 |
| antioxidant | IV-9 | IV-9 | IV-9 | IV-9 | IV-9 | IV-9 |
| Mw (*4) | 58,847 | 90,703 | 125,775 | 55,659 | 118,527 | 64,030 |
| Mz (*5) | 97,215 | 166,894 | 408,768 | 90,724 | 256,374 | 114,166 |
| Mn (*6) | 28,224 | 42,031 | 53,361 | 24,354 | 47,354 | 31,950 |
| dispersion $d_1$ (*7) | 1.652 | 1.840 | 3.250 | 1.630 | 2.163 | 1.783 |
| polydispersity $d_2$ (*8) | 2.085 | 2.158 | 2.357 | 2.285 | 2.503 | 2.004 |
| abrasion $\mu$m (*9) | 0.9 | 1.1 | 0.7 | 0.9 | 0.8 | 1.0 |
| filming | A | A | A | A | A | A |
| dew condensation | a | a | b | a | a | a |

Table entry in the 'filming' row,
A: rarely occurred B: often occurred C: very frequently occurred
Table entry in the 'dew condensation' row,
a: little observed b: fairly observed c: very much observed
(*1) binder resin in the charge transport layer
(*2) charge generation substance
(*3) charge transport substance
(*4) weight-average molecular weight
(*5) z-average molecular weight
(*6) number-average molecular weight
(*7) $d_1$ = Mz/Mw
(*8) $d_2$ = Mw/Mn
(*9) amount of abrasion after 10,000 sheets of printing

TABLE 2

| specimen | E7 | E8 | E9 | E10 | E11 | E12 |
|---|---|---|---|---|---|---|
| CTL binder resin (*1) | III-4 | III-5 | III-6 | III-7 | III-8 | III-2 |
| CG substance (*2) | I-17 | I-17 | I-17 | I-17 | I-17 | I-4 |
| CT substance (*3) | II-7 | II-7 | II-7 | II-7 | II-7 | II-7 |
| antioxidant | IV-9 | IV-9 | IV-9 | IV-9 | IV-9 | IV-9 |
| Mw (*4) | 88,945 | 118,908 | 107,046 | 68,212 | 156,578 | 58,847 |
| Mz (*5) | 167,306 | 193,107 | 276,285 | 121,758 | 367,958 | 97,215 |
| Mn (*6) | 33,794 | 37,987 | 35,072 | 31,404 | 41,423 | 28,224 |
| dispersion $d_1$ (*7) | 1.881 | 1.624 | 2.581 | 1.785 | 2.350 | 1.652 |
| polydispersity $d_2$ (*8) | 2.632 | 3.130 | 3.052 | 2.017 | 3.800 | 2.085 |
| abrasion $\mu$m (*9) | 0.9 | 0.8 | 0.9 | 0.8 | 0.7 | 1.0 |
| filming | A | A | A | A | A | A |
| dew condensation | a | a | a | a | b | a |

Table entry in the 'filming' row,
A: rarely occurred B: often occurred C: very frequently occurred
Table entry in the 'dew condensation' row,
a: little observed b: fairly observed c: very much observed
(*1) binder resin in the charge transport layer
(*2) charge generation substance
(*3) charge transport substance
(*4) weight-average molecular weight
(*5) z-average molecular weight
(*6) number-average molecular weight
(*7) $d_1$ = Mz/Mw
(*8) $d_2$ = Mw/Mn
(*9) amount of abrasion after 10,000 sheets of printing

TABLE 3

| specimen | E13 | E14 | E15 | E16 | E17 |
|---|---|---|---|---|---|
| CTL binder resin (*1) | III-2 | III-2 | III-2 | III-2 | III-2 |
| CG substance (*2) | I-7 | I-17 | I-17 | I-17 | I-17 |
| CT substance (*3) | II-7 | II-4 | II-11 | II-7 | II-7 |
| antioxidant | IV-9 | IV-9 | IV-9 | IV-30 | IV-37 |
| Mw (*4) | 58,847 | 58,847 | 58,847 | 58,847 | 58,847 |
| Mz (*5) | 97,215 | 97,215 | 97,215 | 97,215 | 97,215 |
| Mn (*6) | 28,224 | 28,224 | 28,224 | 28,224 | 28,224 |
| dispersion $d_1$ (*7) | 1.652 | 1.652 | 1.652 | 1.652 | 1.652 |
| polydispersity $d_2$ (*8) | 2.085 | 2.085 | 2.085 | 2.085 | 2.085 |
| abrasion μm (*9) | 0.8 | 0.9 | 0.8 | 1.0 | 0.9 |
| filming | A | A | A | A | A |
| dew condensation | a | a | a | a | a |

Table entry in the 'filming' row,
A: rarely occurred B: often occurred C: very frequently occurred
Table entry in the 'dew condensation' row,
a: little observed b: fairly observed c: very much observed
(*1) binder resin in the charge transport layer
(*2) charge generation substance
(*3) charge transport substance
(*4) weight-average molecular weight
(*5) z-average molecular weight
(*6) number-average molecular weight
(*7) $d_1$ = Mz/Mw
(*8) $d_2$ = Mw/Mn
(*9) amount of abrasion after 10,000 sheets of printing

TABLE 4

| specimen | CE1 | CE2 | CE3 | CE4 | CE5 | CE6 |
|---|---|---|---|---|---|---|
| CTL binder resin (*1) | III-2 | III-2 | III-2 | III-1 | III-1 | III-3 |
| CG substance (*2) | I-17 | I-17 | I-17 | I-17 | I-17 | I-17 |
| CT substance (*3) | II-7 | II-7 | II-7 | II-7 | II-7 | II-7 |
| antioxidant | IV-9 | IV-9 | IV-9 | IV-9 | IV-9 | IV-9 |
| Mw (*4) | 40,636 | 60,845 | 93,562 | 52,831 | 86,158 | 55,705 |
| Mz (*5) | 62,290 | 93,580 | 135,010 | 80,673 | 132,597 | 82,332 |
| Mn (*6) | 22,548 | 38,028 | 53,259 | 32,542 | 47,223 | 31,232 |
| dispersion $d_1$ (*7) | 1.531 | 1.538 | 1.443 | 1.527 | 1.539 | 1.478 |
| polydispersity $d_2$ (*8) | 1.804 | 1.600 | 1.757 | 1.623 | 1.825 | 1.783 |
| abrasion μm (*9) | 1.4 | 1.3 | 1.1 | 1.1 | 1.1 | 1.3 |
| filming | B | B | B | B | B | B |
| dew condensation | a | b | b | a | b | a |

Table entry in the 'filming' row,
A: rarely occurred B: often occurred C: very frequently occurred
Table entry in the 'dew condensation' row,
a: little observed b: fairly observed c: very much observed
(*1) binder resin in the charge transport layer
(*2) charge generation substance
(*3) charge transport substance
(*4) weight-average molecular weight
(*5) z-average molecular weight
(*6) number-average molecular weight
(*7) $d_1$ = Mz/Mw
(*8) $d_2$ = Mw/Mn
(*9) amount of abrasion after 10,000 sheets of printing

TABLE 5

| specimen | CE7 | CE8 | CE9 | CE10 | CE11 |
|---|---|---|---|---|---|
| CTL binder resin (*1) | III-4 | III-5 | III-6 | III-7 | III-8 |
| CG substance (*2) | I-17 | I-17 | I-17 | I-17 | I-17 |
| CT substance (*3) | II-7 | II-7 | II-7 | II-7 | II-7 |
| antioxidant | IV-9 | IV-9 | IV-9 | IV-9 | IV-9 |
| Mw (*4) | 54,789 | 60,612 | 80,106 | 78,943 | 85,191 |
| Mz (*5) | 83,772 | 89,039 | 126,728 | 119,362 | 132,983 |
| Mn (*6) | 33,129 | 34,524 | 45,283 | 42,580 | 45,242 |
| dispersion $d_1$ (*7) | 1.529 | 1.469 | 1.582 | 1.512 | 1.561 |
| polydispersity $d_2$ (*8) | 1.654 | 1.756 | 1.769 | 1.854 | 1.883 |
| abrasion μm (*9) | 1.3 | 1.2 | 1.3 | 1.1 | 1.0 |

TABLE 5-continued

| specimen | CE7 | CE8 | CE9 | CE10 | CE11 |
|---|---|---|---|---|---|
| filming | C | B | B | B | B |
| dew condensation | a | a | b | b | c |

Table entry in the 'filming' row,
A: rarely occurred B: often occurred C: very frequently occurred
Table entry in the 'dew condensation' row,
a: little observed b: fairly observed c: very much observed
(*1) binder resin in the charge transport layer
(*2) charge generation substance
(*3) charge transport substance
(*4) weight-average molecular weight
(*5) z-average molecular weight
(*6) number-average molecular weight
(*7) $d_1$ = Mz/Mw
(*8) $d_2$ = Mw/Mn As is apparent from Tables 1 through 5, excellent printing durability is obtained by a photoconductor using a binder resin so prepared that the dispersion $d_1$=Mz/Mw is at least 1.6 and the polydispersity $d_2$=Mw/Mn is at least 2.0, where each of $d_1$ and $d_2$ is in a value converted to polystyrene standard, and Mz, Mw and Mn, which indicate ranges of molecular weight distribution of the resin, are z-average molecular weight, weight-average molecular weight and number-average molecular weight, respectively.

Every photoconductor of Example 1 through Example 17, which uses a polycarbonate having a dispersion Mz/Mn of at least 1.6 and a polydispersity Mw/Mn of at least 2.0, according to the present invention, showed little abrasion, rare filming, and scare dew condensation. That is to say, the photoconductor of the invention exhibits well-balanced characteristics.

In contrast, every photoconductor of Comparative Example 1 through Comparative Example 11, which uses polycarbonate with dispersion Mz/Mw of less than 1.6 or polydispersity Mw/Mn of less than 2.0, resulted in problems. Namely, when polycarbonate with small molecular weight is used, the amount of abrasion is relatively large. When polycarbonate with large molecular weight is used, while an amount of abrasion is relatively small, the coating process requires plenty of solvent, which raises dew condensation in the process of drying the coated surface of the photoconductor drum. Further, the photoconductors of Comparative Examples are generally liable to cause filming and abrasion, thus, don't exhibit well-balance characteristics.

It is further apparent that the photoconductors of Examples according to the invention commonly showed excellent resistance to abrasion and little occurrence of filming, which secure long life. This effect has been brought about by the use of a polycarbonate that has a range of molecular weight distribution larger than a certain value, namely, dispersion $d_1$=Mz/Mw of at least 1.6 and polydispersity $d_2$=Mw/Mn of at least 2.0, where $d_1$ and $d_2$ are values converted to polystyrene standard. It should be noted that the effects have been attained in every Example according to the invention irrespective of the species of the polycarbonate, charge generation substance, charge transport substance, and antioxidant agent.

As described, the present invention provides a photoconductor that suppresses abrasion and filming in the operation for long periods, and also facilitates the coating process.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An electrophotographic photoconductor comprising:

a conductive substrate; and a photosensitive layer on said conductive substrate; wherein said photosensitive layer containing charge generation substance, charge transport substance and a binder resin; and said binder resin having a dispersion $d_1$, defined by $d_1$=Mz/Mw, of 1.6 to 3.2 and a polydispersity $d_2$, defined by $d_2$=Mw/Mn, of 2.0 to 3.7, in values converted to polystyrene standard, wherein Mz is z-average molecular weight of said binder resin, Mw is a weight-average molecular weight of said binder resin, and Mn is a number-average molecular weight of said binder resin, wherein the photosensitive layer is free of organosilanes.

2. An electrophotographic photoconductor according to claim 1, wherein $d_1$ is from 1.6 to 2.6 and $d_2$ is 2.0 to 3.2.

3. An electrophotographic photoconductor according to claim 1, wherein said binder resin is a polycarbonate resin.

4. An electrophotographic photoconductor according to claim 1, further comprising an antioxidant agent.

5. An electrophotographic photoconductor according to claim 1, wherein said charge generation substance is selected from the group consisting of phthalocyanine compounds an azo compounds.

6. An electrophotographic photoconductor according to claim 1, wherein said charge transport substance is selected from the group consisting of hydrazone compounds and amine compounds.

7. An electrophotographic photoconductor comprising:

a conductive substrate; and a charge generation layer and a charge transport layer on said conductive substrate; wherein said charge transport layer containing a charge transport substance and a binder resin; and said binder resin having a dispersion $d_1$, defined by $d_1$=Mz/Mw, of 1.6 to 3.2 and a polydispersity $d_2$, defined by $d_2$=Mw/Mn, of 2.0 to 3.7, in values converted to polystyrene standard, wherein Mz is a z-average molecular weight of said binder resin, Mw is weight-average molecular weight of said binder resin, an Mn is number-average molecular weight of said binder resin, wherein the charge transport layer and the change generation layer are free of organosilanes.

* * * * *